US009794669B2

(12) United States Patent
Wen et al.

(10) Patent No.: US 9,794,669 B2
(45) Date of Patent: Oct. 17, 2017

(54) DEVICES AND METHODS FOR HEADPHONE SPEAKER IMPEDANCE DETECTION

(71) Applicant: MediaTek Inc., Hsin-Chu (TW)

(72) Inventors: Sung-Han Wen, Taipei (TW); Po-Yi Lee, New Taipei (TW)

(73) Assignee: MediaTek Inc., Hsin-Chu (TW)

( * ) Notice: Subject to any disclaimer, the term of this patent is extended or adjusted under 35 U.S.C. 154(b) by 281 days.

(21) Appl. No.: 14/337,392

(22) Filed: Jul. 22, 2014

(65) Prior Publication Data

US 2015/0230018 A1 Aug. 13, 2015

Related U.S. Application Data

(60) Provisional application No. 61/938,221, filed on Feb. 11, 2014.

(51) Int. Cl.

| | |
|---|---|
| ***H04R 1/10*** | (2006.01) |
| ***H04R 3/00*** | (2006.01) |
| ***H04R 29/00*** | (2006.01) |
| ***H04R 5/04*** | (2006.01) |

(52) U.S. Cl.

CPC ..... *H04R 1/1041* (2013.01); *H04R 3/007* (2013.01); *H04R 29/001* (2013.01); *H04R 5/04* (2013.01)

(58) Field of Classification Search

CPC .... H04R 1/1041; H04R 3/007; H04R 29/001; H04R 5/04

USPC ..... 381/58, 59, 370, 384, 74

See application file for complete search history.

(56) References Cited

U.S. PATENT DOCUMENTS

| | | | | |
|---|---|---|---|---|
| 7,711,128 | B2 | 5/2010 | Hagino | |
| 7,808,324 | B1 | 10/2010 | Woodford et al. | |
| 2004/0081099 | A1* | 4/2004 | Patterson | G06F 13/4081 370/241 |
| 2011/0199123 | A1 | 8/2011 | Maher et al. | |
| 2013/0156230 | A1 | 6/2013 | Dhanasekaran | |
| 2013/0158921 | A1 | 6/2013 | Shah et al. | |
| 2014/0003616 | A1* | 1/2014 | Johnson | H04R 29/001 381/74 |
| 2015/0078558 | A1* | 3/2015 | Thandri | H04R 1/1041 381/59 |
| 2015/0078559 | A1* | 3/2015 | Ilango | H04R 29/001 381/59 |
| 2015/0358719 | A1* | 12/2015 | Mackay | G06F 11/3051 381/384 |

FOREIGN PATENT DOCUMENTS

WO WO 2009/134537 11/2009

* cited by examiner

*Primary Examiner* — David Ton

(74) *Attorney, Agent, or Firm* — Wolf, Greenfield & Sacks, P.C.

(57) ABSTRACT

An electronic device includes an impedance detection circuit and a processor. The impedance detection circuit is configured for receiving a test signal, processing the test signal and detecting an impedance of a headphone speaker load by using the test signal to generate a detection result. The processor is coupled to the impedance detection circuit and configured for providing the test signal to the impedance detection circuit, receiving the detection result from the impedance detection circuit, and adjusting a voltage of an audio signal to be provided to the headphone speaker load according to the detection result.

14 Claims, 14 Drawing Sheets

DEVICES AND METHODS FOR HEADPHONE SPEAKER IMPEDANCE DETECTION

CROSS REFERENCE TO RELATED APPLICATIONS

This application claims the benefit of U.S. Provisional Application No. 61/938,221 filed 2014 Feb. 11 and entitled "Headphone Speaker Impedance Detection". The entire contents of which are hereby incorporated by reference.

BACKGROUND OF THE INVENTION

Field of the Invention

The invention relates to devices and methods for headphone speaker impedance detection.

Description of the Related Art

In the art of electronic circuit design, amplifiers may often be designed to drive loads having indeterminate impedances. For example, an audio power amplifier may be required to drive headphones from a plurality of different manufacturers, and each type of headphone may have different impedance. Furthermore, the impedance of any particular load may change over time, due to factors such as temperature, mechanical degradation, etc.

To optimize power delivery to a load by an amplifier, it would be desirable to determine the load impedance prior to driving the load. In audio applications, for example, this would prevent a headphone from being driven by an unsuitably high output voltage. There is accordingly a need to provide simple and robust techniques for accurately estimating the impedance of a load coupled to an amplifier output.

BRIEF SUMMARY OF THE INVENTION

Electronic devices and methods for headphone speaker impedance detection are provided. An exemplary embodiment of an electronic device comprises an impedance detection circuit and a processor. The impedance detection circuit is configured for receiving a test signal, processing the test signal and detecting an impedance of a headphone speaker load by using the test signal to generate a detection result. The processor is coupled to the impedance detection circuit and configured for providing the test signal to the impedance detection circuit, receiving the detection result from the impedance detection circuit, and adjusting a voltage of an audio signal to be provided to the headphone speaker load according to the detection result An exemplary embodiment of a method for headphone speaker impedance detection comprises: providing a test signal; detecting an impedance of a headphone speaker load by using the test signal to generate a detection result; and adjusting a voltage of an audio signal to be provided to the headphone speaker load according to the detection result.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
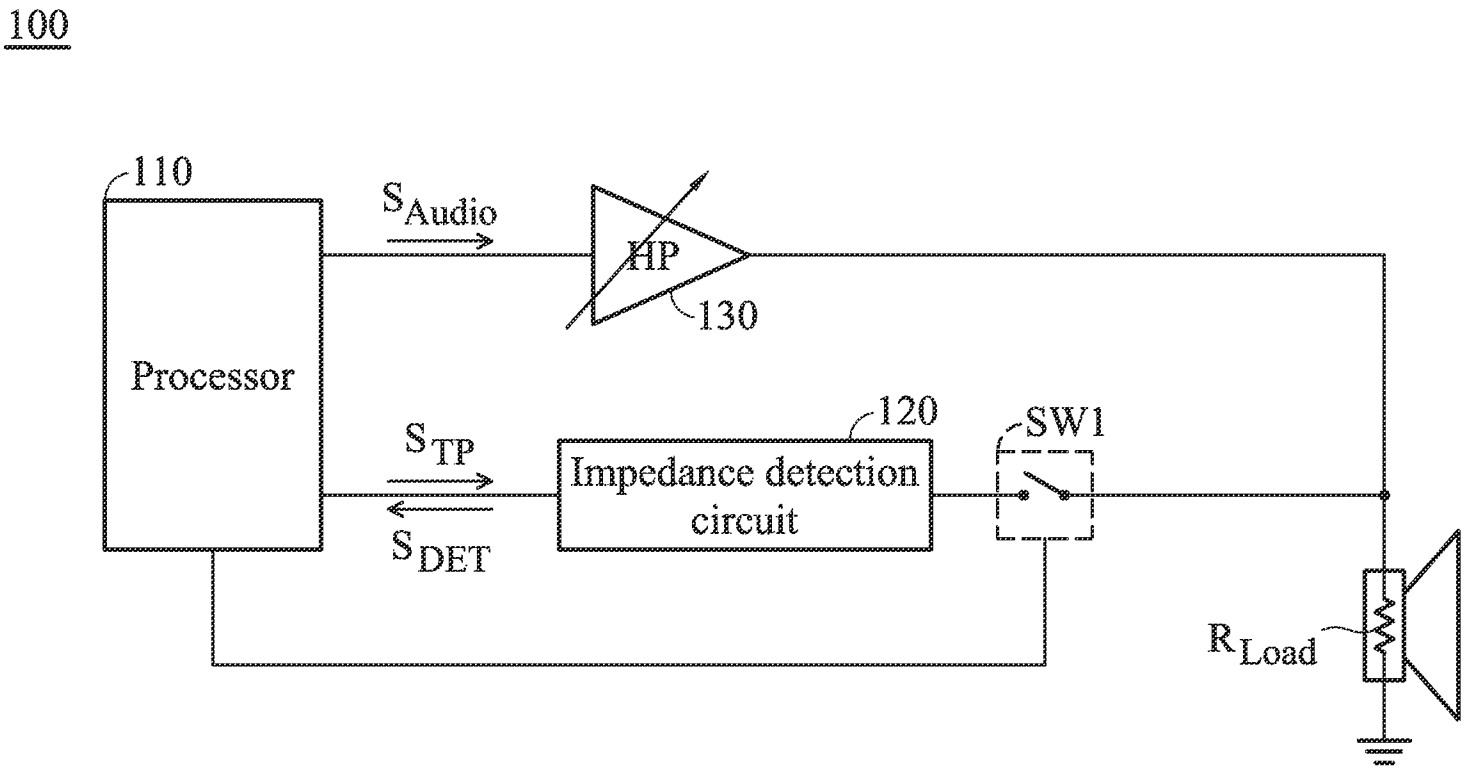
FIG. 1 is a block diagram of an electronic device according to an embodiment of the invention.

FIG. 1 is a block diagram of an electronic device according to an embodiment of the invention. The electronic device 100 may at least comprise a processor 110, an impedance detection circuit 120 and a headphone amplifier HP 130. A headphone with a headphone speaker load $R_{Load}$ may be electrically connected to the electronic device 100 when a headphone jack thereof is plugged in a headphone socket of the electronic device 100. The impedance detection circuit 120 is configured for detecting an impedance of the headphone speaker load $R_{Load}$ coupled thereto according to a test signal $S_{TP}$ and accordingly generating a detection result $S_{DET}$. When obtaining the detection result $S_{DET}$, the processor 110 may further adjust a voltage of an audio signal $S_{Audio}$ to be provided to the headphone speaker load $R_{Load}$ according to the detection result $S_{DET}$, such that a volume of the audio signal $S_{Audio}$ perceived by the user wearing the headphone can be adequate and can be kept substantially the same, regardless of which headphone is plugged into the electronic device 100. Generally, different types or brands of headphones may have different sensitivity and different impedance. When the audio signal $S_{Audio}$ with the same voltage is provided to different headphones with different impedance, different power will be output by the headphone and thus different volume will be heard by the user.

However, excessive volume due to large output power will cause undesirable experience to the user. Therefore, in the embodiments of the invention, the impedance detection circuit 120 is utilized to detect the impedance of the headphone speaker load $R_{Load}$ right after a headphone is plugged in the electronic device 100. After detecting the impedance of the headphone speaker load $R_{Load}$, the voltage of the audio signal $S_{Audio}$ output by the electronic device 100 can be well-controlled, and the volume of the audio signal $S_{Audio}$ perceived by the user wearing the headphone can be adequate and kept substantially the same, regardless of which headphone is plugged in the electronic device 100.

According to an embodiment of the invention, the processor 110 may further control the on/off status of the switch SW1, so as to selectively couple the impedance detection circuit 120 to the headphone speaker load $R_{Load}$. For example, after the impedance detection is completed, the processor 110 may control the switch SW1 so as to decouple the impedance detection circuit 120 from the headphone speaker load $R_{Load}$ and couple the headphone amplifier HP 130 to the headphone speaker load $R_{Load}$. Note that, in order to clarify the concept of the invention, FIG. 1 presents a simplified block diagram of an electronic device. However, the invention should not be limited to what is shown in FIG. 1.

Figure 2:
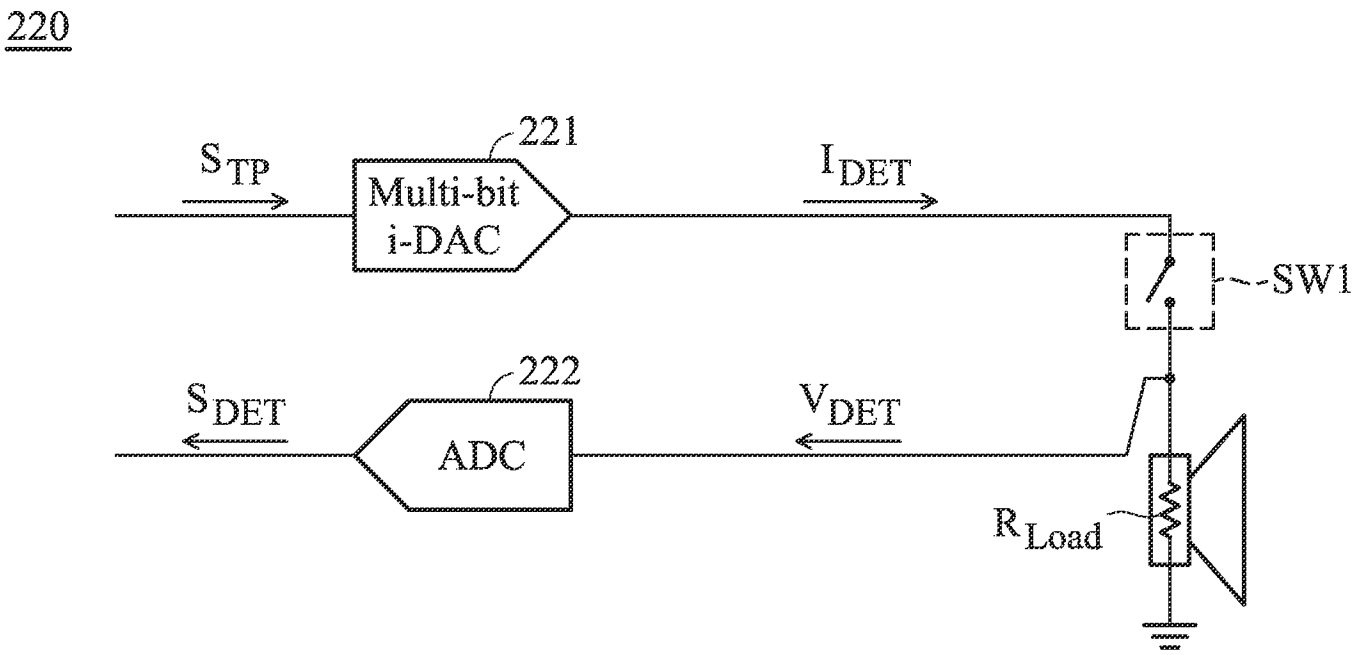
FIG. 2 is a block diagram of an impedance detection circuit according to an embodiment of the invention.

FIG. 2 is a block diagram of an impedance detection circuit according to an embodiment of the invention. The impedance detection circuit 220 may at least comprise a multi-bit current digital to analog converter (i-DAC) 221 and an analog to digital converter (ADC) 222. The multi-bit i-DAC 221 is configured for digital-to-analog converting the test signal $S_{TP}$, which may be a current signal, received from the processor to a detection current $I_{DET}$. The detection current $I_{DET}$ is provided to the headphone speaker load $R_{Load}$ to generate a detection voltage $V_{DET}$. The ADC 222 is configured for analog-to-digital converting the detection voltage $V_{DET}$ to the detection result $S_{DET}$.

Figure 3:
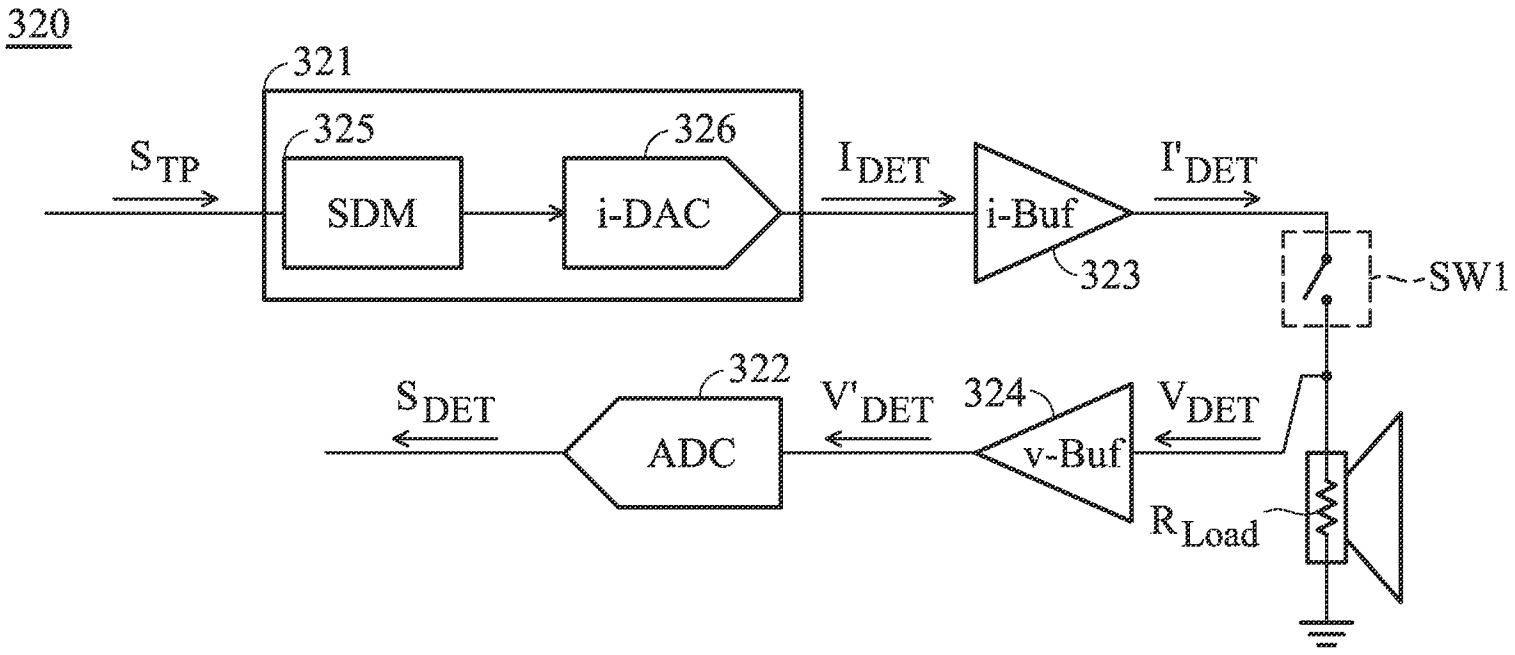
FIG. 3 is a block diagram of an impedance detection circuit according to another embodiment of the invention.

FIG. 3 is a block diagram of an impedance detection circuit according to another embodiment of the invention. The impedance detection circuit 320 may at least comprise a multi-bit i-DAC 321, a current buffer i-Buf 323, a voltage buffer v-Buf 324 and an ADC 322. The multi-bit i-DAC 321 is configured for digital-to-analog converting the test signal $S_{TP}$ received from the processor to a detection current $I_{DET}$. The current buffer i-Buf 323 is configured for further driving or amplifying the detection current $I_{DET}$ to generate an amplified detection current $I'_{DET}$. The amplified detection current $I'_{DET}$ is provided to the headphone speaker load $R_{Load}$ to generate a detection voltage $V_{DET}$. The voltage buffer v-Buf 324 is configured for further driving or amplifying the detection voltage $V_{DET}$ to generate an amplified detection voltage $V'_{DET}$. The ADC 322 is configured for analog-to-digital converting the amplified detection voltage $V'_{DET}$ to the detection result $S_{DET}$.

In a preferred embodiment of the invention, the multi-bit i-DAC 321 may comprise a sigma delta modulator SDM 325 and a current DAC i-DAC 326. However, the invention should not be limited thereto. A person of ordinary skill in the art will readily appreciate that there are a variety of ways to implement the multi-bit i-DAC 221/321, the current buffer i-Buf 323, the voltage buffer v-Buf 324 and the ADC 222/322 for achieving different performance requirements.

According to an embodiment of the invention, the multi-bit i-DAC 221/321 may be shared by the headphone amplifier and the impedance detection circuit, and the processor may generate a plurality of control signals to control a plurality of switches, so as to dynamically control the signal processing path of the audio signal.

Figure 4:
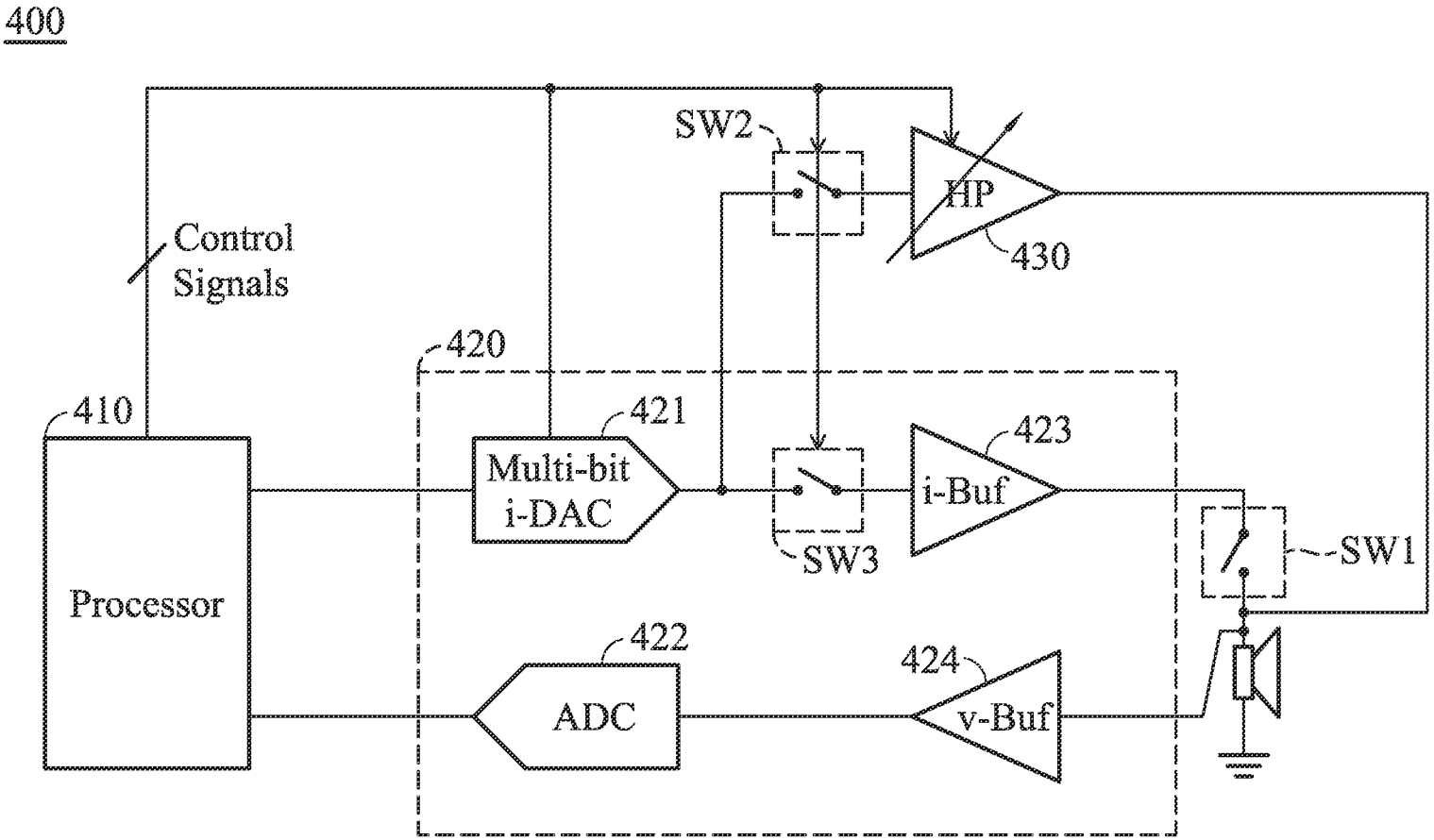
FIG. 4 is a block diagram of an electronic device according to another embodiment of the invention.

FIG. 4 is a block diagram of an electronic device 400 according to another embodiment of the invention. In the embodiment of the invention, the multi-bit i-DAC 421 is shared by the headphone amplifier 430 and the impedance detection circuit 420. The processor 410 may generate a plurality of control signals to control the on/off status of the switches SW1, SW2 and SW3.

Figure 5:
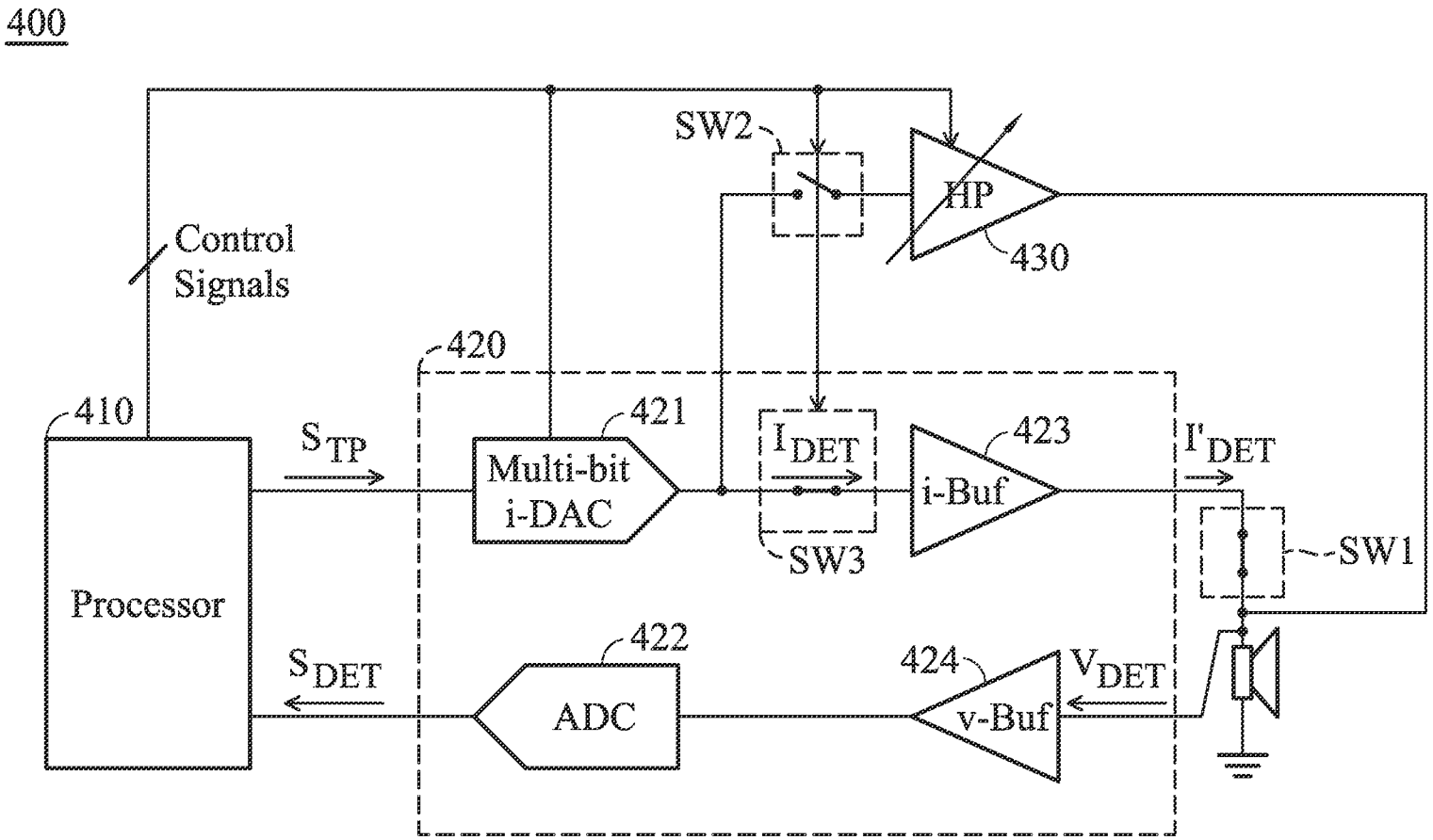
FIG. 5 is a block diagram of the electronic device 400 operating in an impedance detection state according to an embodiment of the invention.

FIG. 5 is a block diagram of the electronic device 400 operating in an impedance detection state according to an embodiment of the invention. When the electronic device 400 operates in the impedance detection state, the processor 410 may generate corresponding control signals to close the switches SW1 and SW3 and open the switch SW2. In this manner, the detection current $I_{DET}$ generated by the multi-bit i-DAC 421 according to the test signal $S_{TP}$ is provided to the current buffer i-Buf 423, and the amplified detection current $I'_{DET}$ is then provided to the headphone speaker load for impedance detection. The detection voltage $V_{ET}$ generated based on the amplified detection current $I'_{DET}$ (or, the detection current $I_{DET}$ as the embodiment shown in FIG. 2) is received by the voltage buffer v-Buf 424 and processed by the voltage buffer v-Buf 424 and the ADC 422 to generate the detection result $S_{DET}$. Note that in the embodiment of the invention, the output of the headphone amplifier HP 430 is floating in the impedance detection state.

Figure 6:
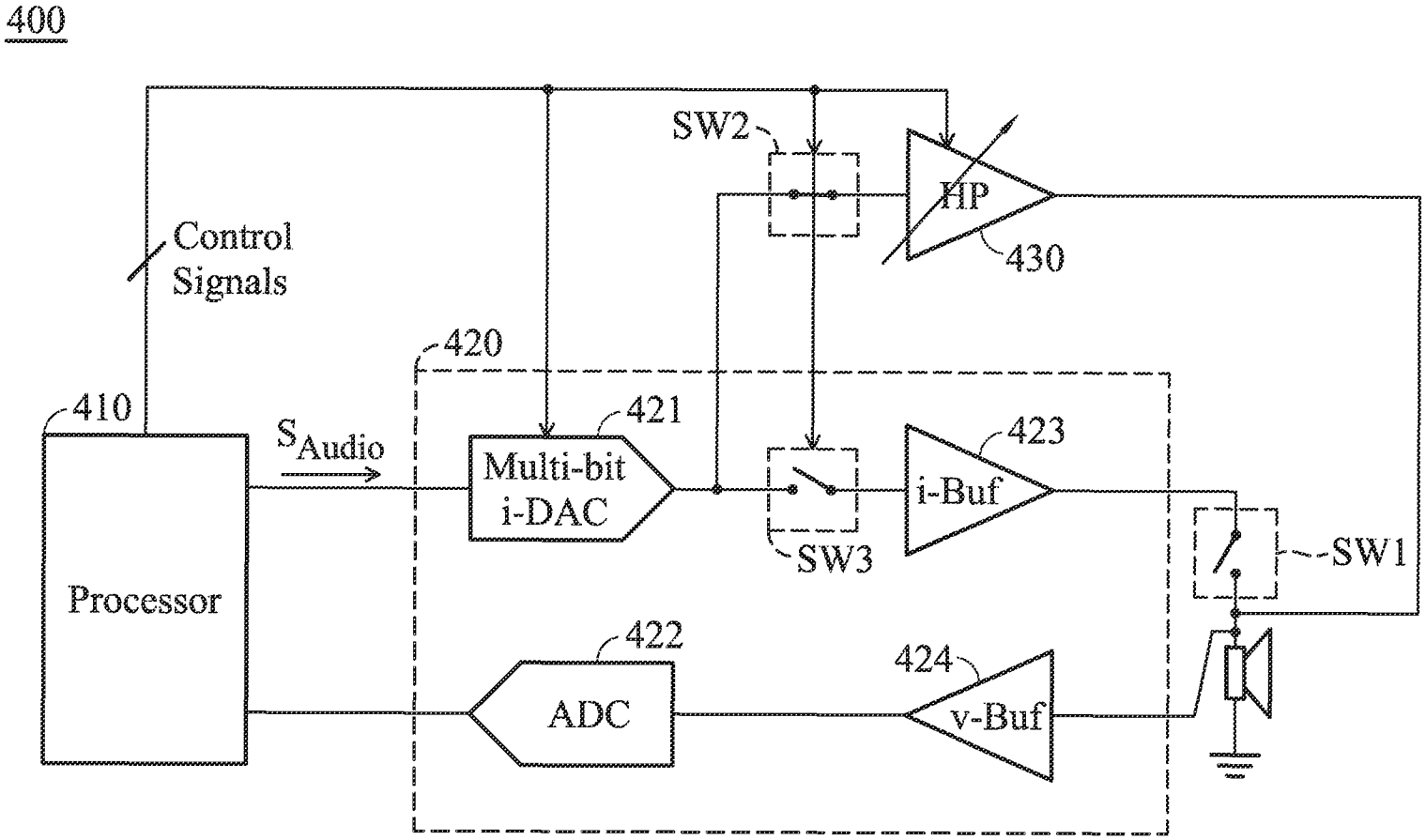
FIG. 6 is a block diagram of the electronic device 400 operating in an audio signal playback state according to an embodiment of the invention.

FIG. 6 is a block diagram of the electronic device 400 operating in an audio signal playback state according to an embodiment of the invention. When the electronic device 400 operates in the audio signal playback state, the processor 410 may generate corresponding control signals to open the switches SW1 and SW3 and close the switch SW2. In this manner, the audio signal $S_{Audio}$ is provided to the headphone amplifier HP 430 after digital-to-analog conversion of the multi-bit i-DAC 421.

As discussed above, once a headphone is plugged in, the electronic device may operate in the impedance detection state for detecting the impedance of the plugged in headphone to obtain the detection result. After obtaining the detection result, the voltage of the audio signal $S_{Audio}$ output by the electronic device can be well-controlled, such that a volume of the audio signal $S_{Audio}$ output by the electronic device in the audio signal playback state can be adequate and kept substantially the same, regardless of which headphone is plugged in the electronic device. In other words, in the embodiments of the invention, the voltage of the audio signal $S_{Audio}$ output by the electronic device can be dynamically adjusted according to the impedance of the plugged-in headphone speaker.

According to an embodiment of the invention, the processor 110/410 may adjust the voltage of the audio signal $S_{Audio}$ by adjusting the gain of the headphone amplifier HP 130/430. According to another embodiment of the invention, the processor 110/410 may be a digital signal processor and may process the audio signal $S_{Audio}$ before outputting the audio signal $S_{Audio}$, and the processor 110/410 may adjust the voltage of the audio signal $S_{Audio}$ by adjusting the gain utilized by the processor 110/410 for processing the audio signal $S_{Audio}$.

Figure 7:
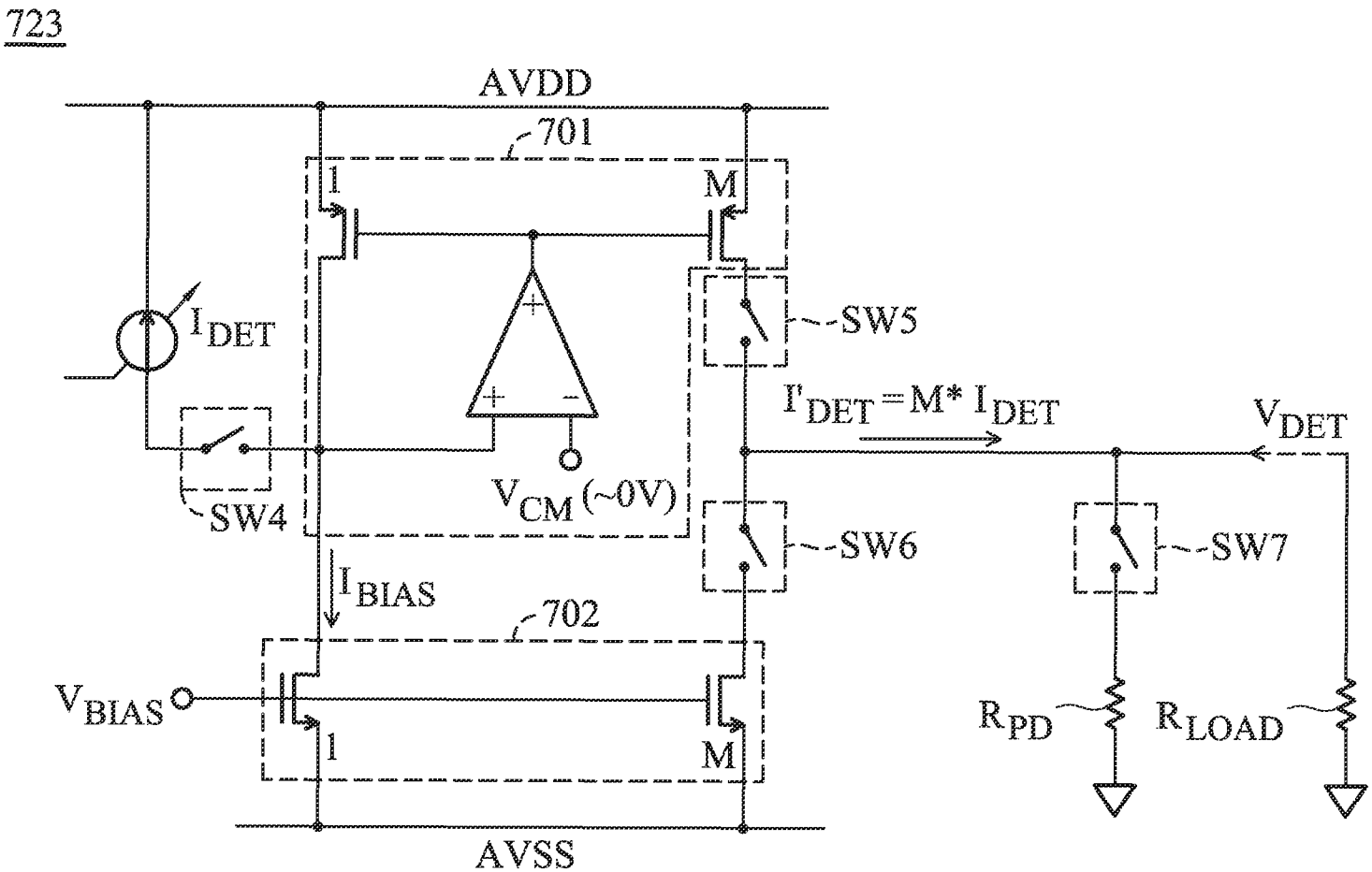
FIG. 7 is an exemplary circuit diagram of the current buffer i-Buf according to an embodiment of the invention.

FIG. 7 is an exemplary circuit diagram of the current buffer i-Buf according to an embodiment of the invention. The current buffer i-Buf 723 may comprise a current mirror 701 formed by a pair of PMOS transistors and an amplifier and a current load 702 formed by a pair of NMOS transistors. The current buffer i-Buf 723 may receive the detection current $I_{DET}$ from the multi-bit i-DAC in the previous stage and amplify the detection current $I_{DET}$ via the current mirror 701. In the embodiment, the amplified detection current $I'_{DET}$ is M times the detection current $I_{DET}$, where M is a positive value and is the ratio of the transistor pairs in the current mirror 701. The current buffer i-Buf 723 may further comprise a plurality of switches SW4, SW5, SW6 and SW7 and a power down resistor $R_{PD}$. The on/off status of the switches SW4, SW5, SW6 and SW7 may be controlled by the processor according to power down control signals. For example, when the electronic device operates in the impedance detection state, the processor may generate corresponding power down control signal, such as power down bar signal PDb, so as to close the switches SW4-SW6 and open the switch SW7. When the electronic device leaves the impedance detection state, the processor may generate corresponding power down control signal, such as power down signal PD, so as to open the switches SW4-SW6 and close the switch SW7 and the current buffer i-Buf can be powered down accordingly.

According to an embodiment of the invention, the amplifier comprised in the current mirror 701 may lock the common mode voltage at the non-inverting input node of the amplifier to 0 Volts, such that the input impedance looking into the current buffer i-Buf 723 from the multi-bit i-DAC in the previous stage is very small. In this manner, the mirrored current will not be affected by the disturbance that occurs in the multi-bit i-DAC and the non-linearity of the multi-bit i-DAC can be reduced accordingly.

Figure 8:
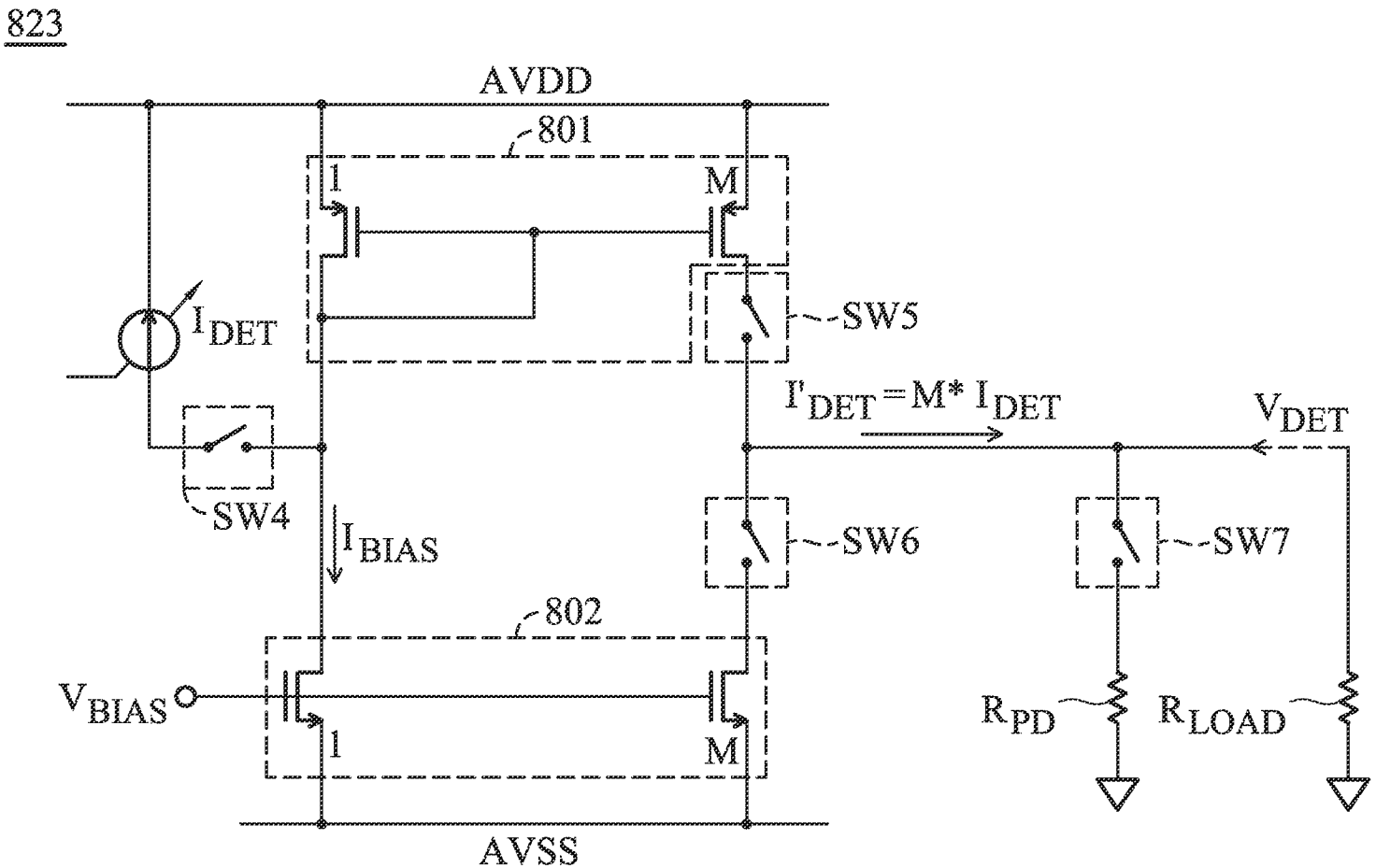
FIG. 8 is an exemplary circuit diagram of the current buffer i-Buf according to another embodiment of the invention.

FIG. 8 is an exemplary circuit diagram of the current buffer i-Buf according to another embodiment of the invention. The current buffer i-Buf 823 may comprise a current mirror 801 formed by a pair of PMOS transistors, a current load 802 formed by a pair of NMOS transistors, a plurality of switches SW4, SW5, SW6 and SW7 and a power down resistor $R_{PD}$. Operations of the current buffer i-Buf 823 are similar to these of the current buffer i-Buf 723. For the descriptions of the current buffer i-Buf 823, reference may be made to the descriptions of the current buffer i-Buf 723, and are omitted here for brevity.

Figure 9:
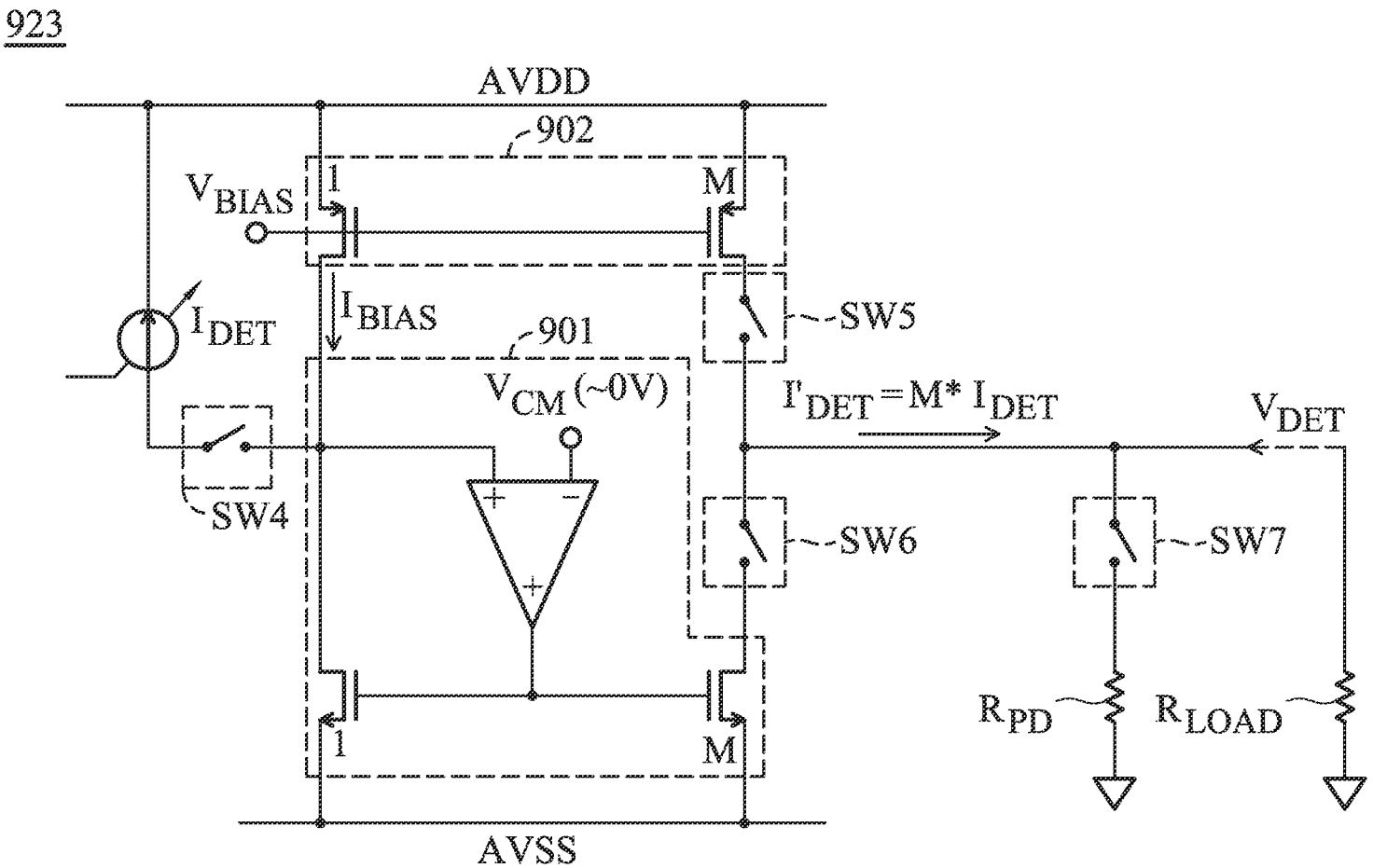
FIG. 9 is an exemplary circuit diagram of the current buffer i-Buf according to yet another embodiment of the invention.

FIG. 9 is an exemplary circuit diagram of the current buffer i-Buf according to yet another embodiment of the invention. The current buffer i-Buf 923 may comprise a current mirror 901 formed by a pair of NMOS transistors and an amplifier, a current load 902 formed by a pair of PMOS transistors, a plurality of switches SW4, SW5, SW6 and SW7 and a power down resistor $R_{PD}$. Operations of the current buffer i-Buf 923 are similar to these of the current buffer i-Buf 723. For the descriptions of the current buffer i-Buf 923, reference may be made to the descriptions of the current buffer i-Buf 723, and are omitted here for brevity.

Figure 10:
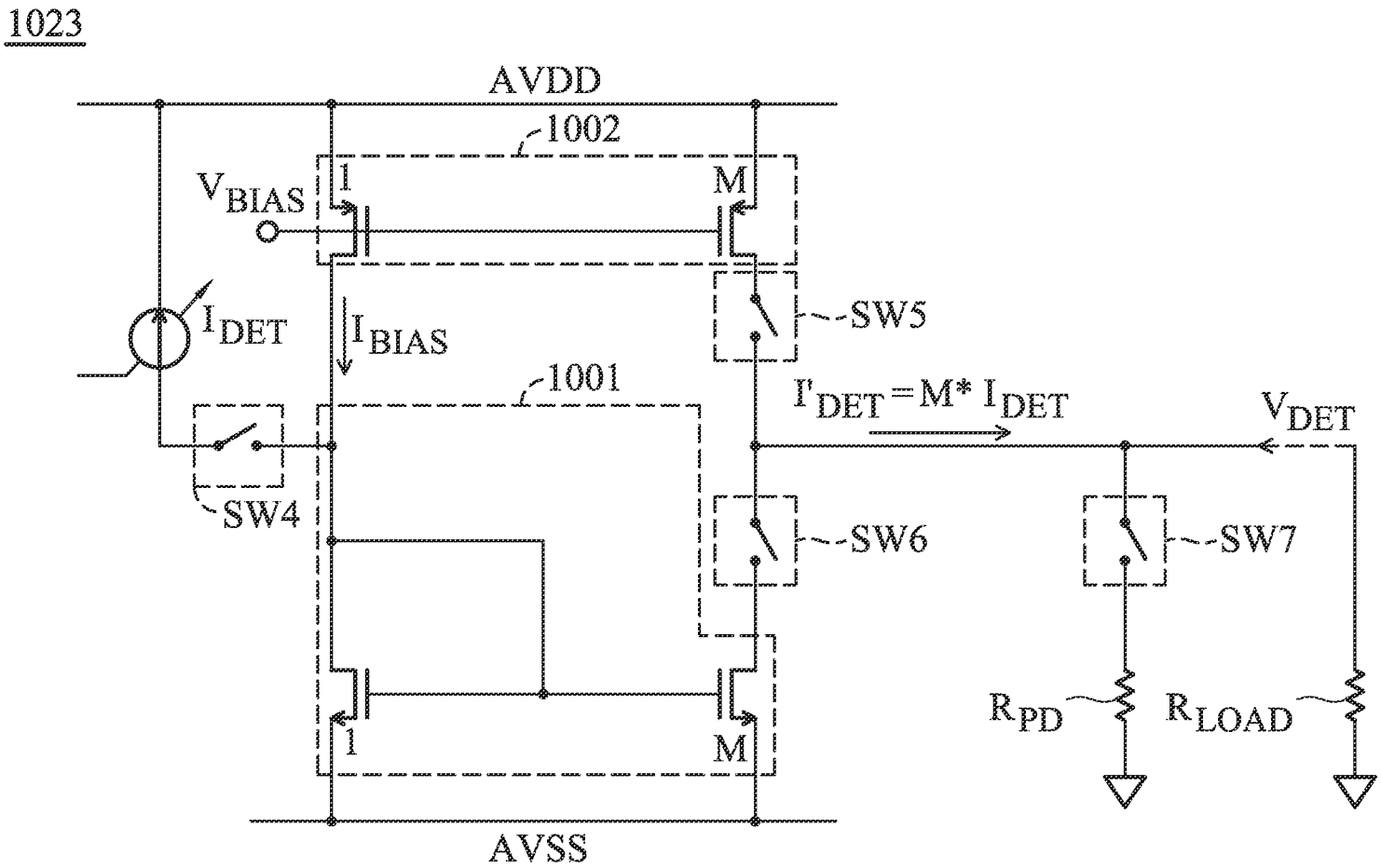
FIG. 10 is an exemplary circuit diagram of the current buffer i-Buf according to still another embodiment of the invention.

FIG. 10 is an exemplary circuit diagram of the current buffer i-Buf according to still another embodiment of the invention. The current buffer i-Buf 1023 may comprise a current mirror 1001 formed by a pair of NMOS transistors, a current load 1002 formed by a pair of PMOS transistors, a plurality of switches SW4, SW5, SW6 and SW7 and a power down resistor $R_{PD}$. Operations of the current buffer i-Buf 1023 are similar to that of the current buffer i-Buf 723. For the descriptions of the current buffer i-Buf 1023, reference may be made to the descriptions of the current buffer i-Buf 723, and are omitted here for brevity.

According to an embodiment of the invention, the test signal $S_{TP}$ may be a multiple integral signal. For example, the test signal $S_{TP}$ may be a double integral signal generated based on a double integral method. In some other embodiments of the invention, the test signal $S_{TP}$ may also be other kinds of signals, such as a step signal, a ramp signal or others, and the invention should not be limited thereto.

Figure 11:
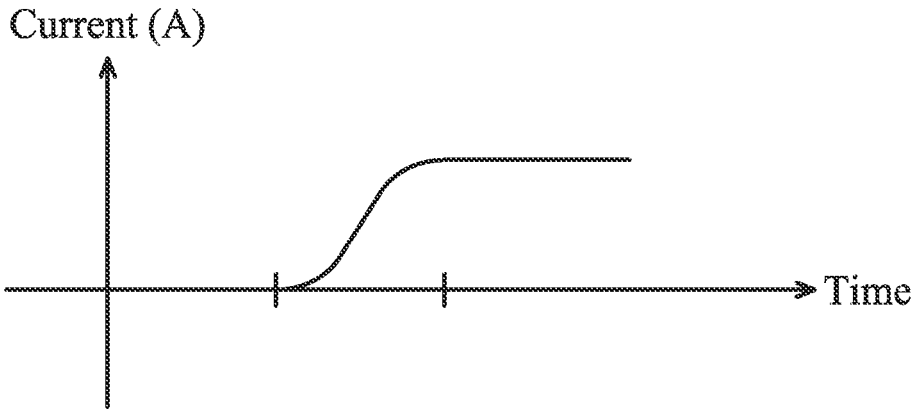
FIG. 11 shows an exemplary waveform of a test signal utilized for headphone speaker impedance detection in a preferred embodiment of the invention.

FIG. 11 shows an exemplary waveform of a test signal utilized for headphone speaker impedance detection in a preferred embodiment of the invention. Since the popping noise generated by the double integral signal or the multiple integral signal is very tiny and will likely not be heard by the user, as will be illustrated in the following paragraphs, the test signal is preferably selected as the double integral signal as shown in FIG. 11 or a multiple integral signal in the preferred embodiments of the invention.

Figure 12:
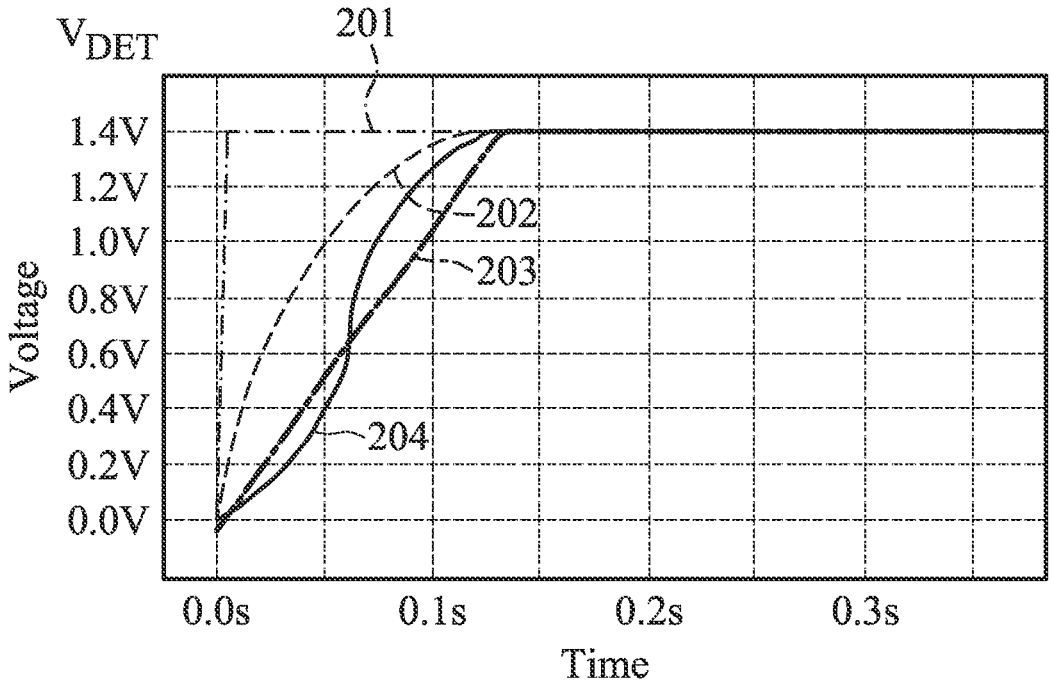
FIG. 12 shows the exemplary waveforms of the detection voltages obtained according to the test signals generated by different methods according to an embodiment of the invention.

FIG. 12 shows the exemplary waveforms of the detection voltages obtained according to the test signals generated by different methods according to an embodiment of the invention. The curve 201 shows the detection voltage $V_{DET}$ obtained according to a step signal. The curve 202 shows the detection voltage $V_{DET}$ obtained according to a first ramp signal. The curve 203 shows the detection voltage $V_{DET}$ obtained according to a second ramp signal. The curve 204 shows the detection voltage $V_{DET}$ obtained according to a double integral signal.

Figure 13:
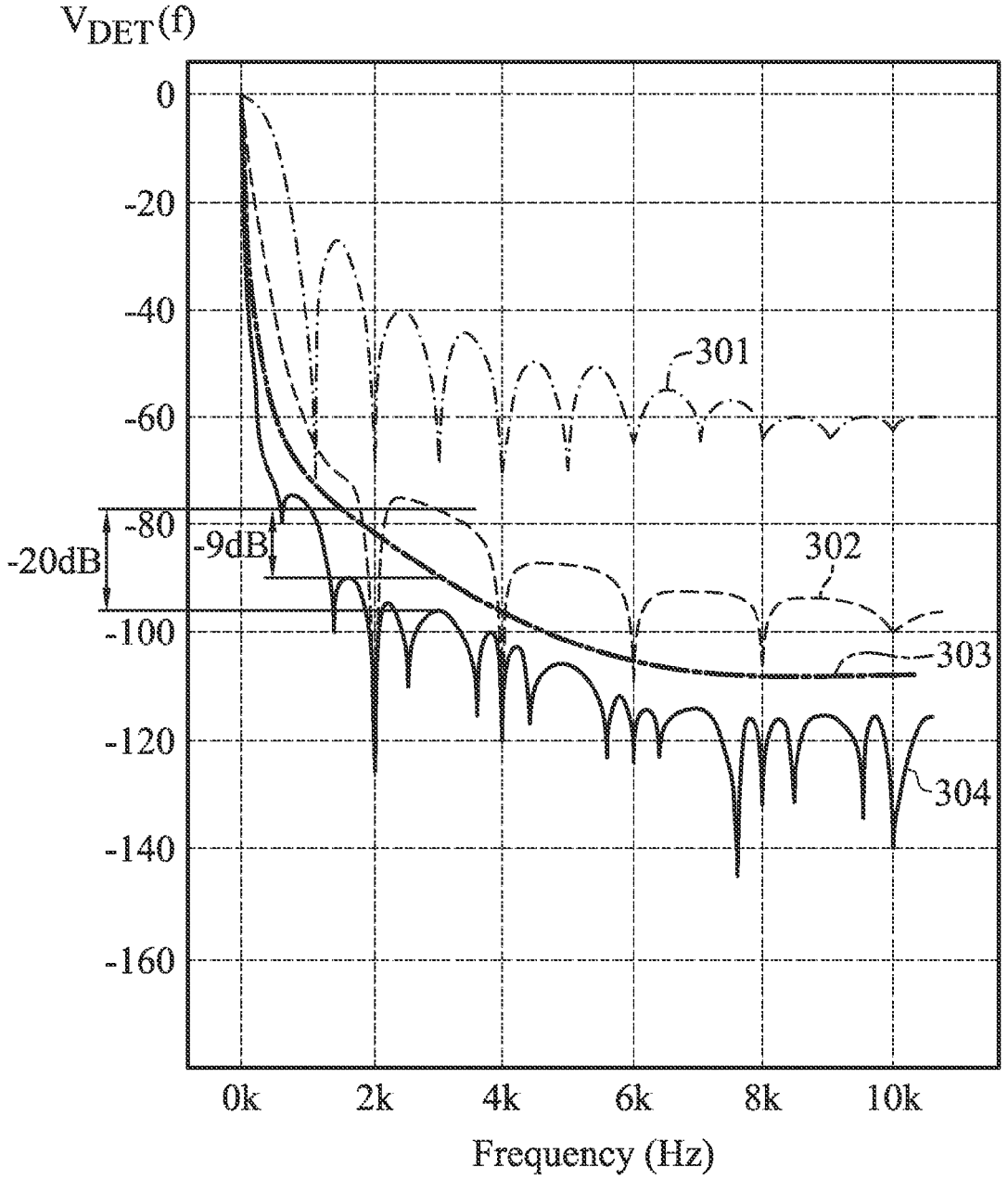
FIG. 13 shows the exemplary waveforms of the frequency spectrums of the detection voltages show in FIG. 12 according to an embodiment of the invention.

FIG. 13 shows the exemplary waveforms of the frequency spectrums of the detection voltages shown in FIG. 12 according to an embodiment of the invention. The curve 301 shows the frequency spectrum of the detection voltage $V_{DET}$ shown by the curve 201, the curve 302 shows the frequency spectrum of the detection voltage $V_{DET}$ shown by the curve 202, the curve 303 shows the frequency spectrum of the detection voltage $V_{DET}$ shown by the curve 203, and the curve 304 shows the frequency spectrum of the detection voltage $V_{DET}$ shown by the curve 204. As shown in FIG. 13, the curve 304 has the smallest in-band energy among the curves 301-304. Therefore, the pop noise generated by the double integral signal when performing headphone speaker impedance detection is the smallest among these signals.

Figure 14:
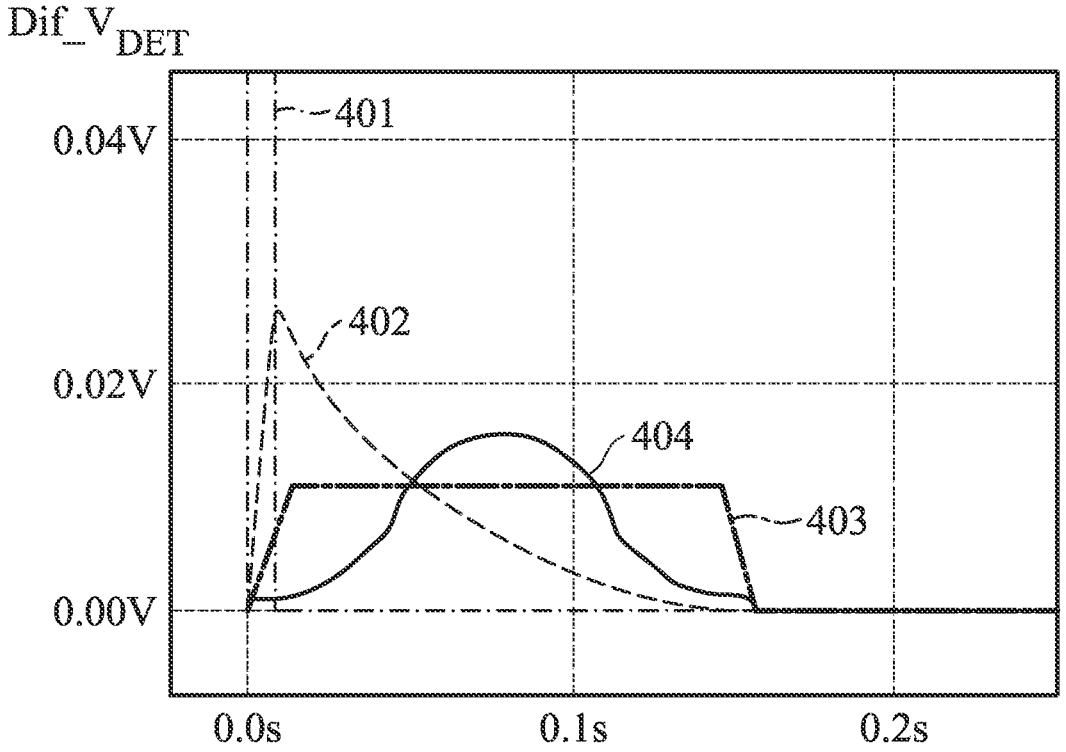
FIG. 14 shows the exemplary waveforms of the first order differentiation result of the detection voltages show in FIG. 12 according to an embodiment of the invention.

FIG. 14 shows the exemplary waveforms of the first order differentiation result of the detection voltages show in FIG. 12 according to an embodiment of the invention. The curve 401 shows the first order differentiation result of the detection voltage $V_{DET}$ shown by the curve 201, the curve 402 shows the first order differentiation result of the detection voltage $V_{DET}$ shown by the curve 202, the curve 403 shows the first order differentiation result of the detection voltage $V_{DET}$ shown by the curve 203, and the curve 404 shows the first order differentiation result of the detection voltage $V_{DET}$ shown by the curve 204. As shown in FIG. 14, the curve 404 is still a continuous signal after differentiation. Therefore, the double integral signal has the smallest high-frequency noise among these signals.

Figure 15:
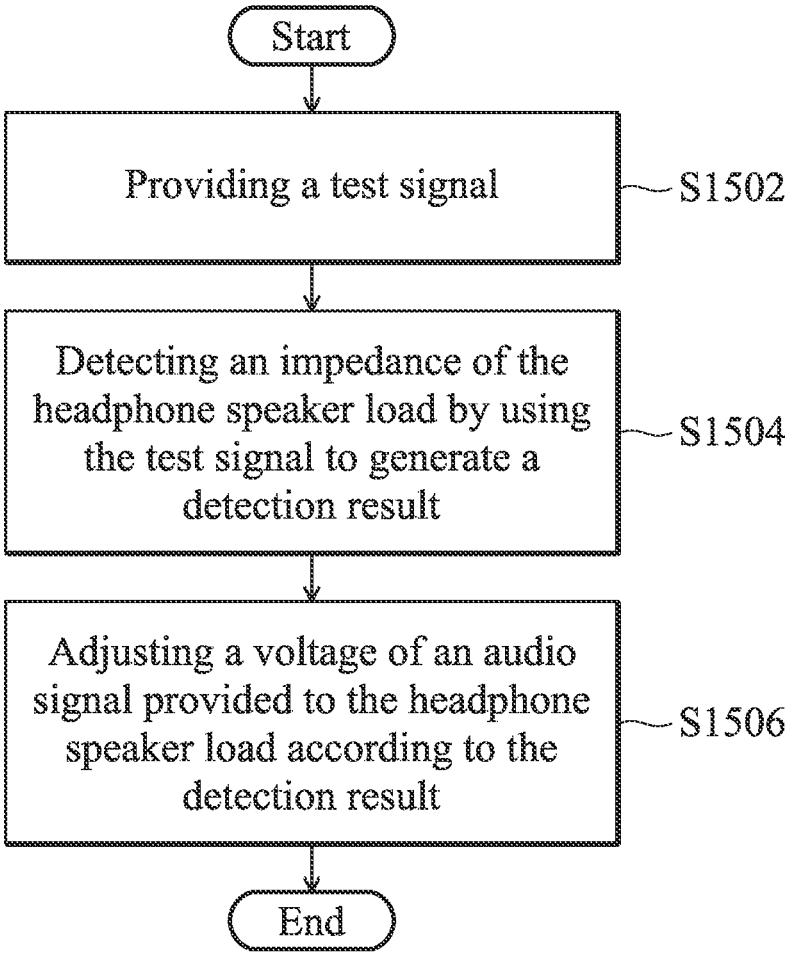
FIG. 15 is a flow chart of a method for headphone speaker impedance detection according to an embodiment of the invention.

FIG. 15 is a flow chart of a method for headphone speaker impedance detection according to an embodiment of the invention. First of all, a test signal is provided to a headphone speaker load (Step S1502). As discussed above, the test signal is preferably generated by a double integral method or a multiple integral method so as to reduce the pop noise perceived by a user wearing the headphone as much as possible. Next, an impedance of the headphone speaker load is detected by using the test signal to generate a detection result (Step S1504). Finally, a voltage of an audio signal provided to the headphone speaker load is adjusted according to the detection result (Step S1506), such that a volume of the audio signal perceived by a user wearing the headphone when the electronic device operates in the audio playback state can be adequate and kept substantially the same, regardless of which headphone is plugged in the electronic device.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. An electronic device, comprising:

an impedance detection circuit, configured for receiving a test signal, processing the test signal using at least a current digital to analog converter and detecting an impedance of a headphone speaker load by using the test signal to generate an impedance detection result; and a processor, coupled to the impedance detection circuit and configured for providing the test signal to the impedance detection circuit, receiving the impedance detection result from the impedance detection circuit, and adjusting a voltage of an audio signal to be provided to the headphone speaker load through the current digital to analog converter according to the impedance detection result, wherein the test signal is a current signal.

2. The electronic device as claimed in claim 1, wherein the test signal is a multiple integral signal.

3. The electronic device as claimed in claim 1, further comprising:

a headphone amplifier, coupled to the headphone speaker load and configured for amplifying the audio signal to be provided to the headphone speaker load according to a gain, wherein the processor adjusts the voltage of the audio signal by adjusting the gain of the headphone amplifier.

4. The electronic device as claimed in claim 1, wherein the processor further processes the audio signal according to a gain, and the processor adjusts the voltage of the audio signal by adjusting the gain.

5. The electronic device as claimed in claim 1, wherein the impedance detection circuit comprises:

a multi-bit current digital to analog converter, configured for digital-to-analog converting the test signal; and an analog to digital converter, configured for analog-to-digital converting a detection voltage to the impedance detection result.

6. The electronic device as claimed in claim 5, further comprising:

a current buffer, coupled to the multi-bit current digital to analog converter and configured for amplifying the test signal.

7. The electronic device as claimed in claim 6, wherein the current buffer comprises:

a current mirror; and a current load, coupled to the current mirror.

8. The electronic device as claimed in claim 5, further comprising:

a voltage buffer, coupled to the analog to digital converter and configured for amplifying the detection voltage.

9. The electronic device as claimed in claim 1, wherein:

the device further comprises a switch configured to selectively couple the impedance detection circuit to and decouple the impedance detection circuit from the headphone speaker load; and the processor is configured for controlling the switch to couple the impedance detection circuit to the headphone speaker load, providing the test signal to the impedance detection circuit responsive to detection of the headphone speaker load, receiving the impedance detection result from the impedance detection circuit, and controlling the switch to decouple the impedance detection circuit from the headphone speaker load.

10. A method for headphone speaker impedance detection, comprising:

providing a test signal through a current digital to analog converter;

detecting an impedance of a headphone speaker load by using the test signal to generate an impedance detection result; and adjusting a voltage of an audio signal to be provided to the headphone speaker load through the current digital to analog converter according to the impedance detection result, wherein the test signal is a current signal.

11. The method as claimed in claim 10, wherein the test signal is a multiple integral signal.

12. The method as claimed in claim 10, wherein the test signal is a ramp signal.

13. The method as claimed in claim 10, wherein the step of adjusting the voltage of the audio signal to be provided to the headphone speaker load according to the impedance detection result is performed by adjusting a gain of a headphone amplifier coupled to the headphone speaker load according to the impedance detection result.

14. The method as claimed in claim 10, further comprising:

processing the audio signal according to a gain before providing the audio signal to the headphone speaker load, wherein the step of adjusting the voltage of the audio signal to be provided to the headphone speaker load according to the impedance detection result is performed by adjusting the gain according to the impedance detection result.

* * * * *